US009322122B2

(12) United States Patent
Aprea et al.

(10) Patent No.: US 9,322,122 B2
(45) Date of Patent: Apr. 26, 2016

(54) APPARATUS FOR RINSING DIAPERS

(76) Inventors: David J. Aprea, Huntington Beach, CA (US); Jennifer K. Aprea, Huntington Beach, CA (US)

( * ) Notice: Subject to any disclaimer, the term of this patent is extended or adjusted under 35 U.S.C. 154(b) by 522 days.

(21) Appl. No.: 13/523,379

(22) Filed: Jun. 14, 2012

(65) Prior Publication Data

US 2013/0125303 A1 May 23, 2013

Related U.S. Application Data

(60) Provisional application No. 61/520,748, filed on Jun. 14, 2011.

(51) Int. Cl.
*E03D 9/00* (2006.01)
*D06F 7/00* (2006.01)
*D06F 51/00* (2006.01)

(52) U.S. Cl.
CPC .. *D06F 7/00* (2013.01); *D06F 51/00* (2013.01)

(58) Field of Classification Search
USPC ..... 4/666; 68/235 R, 223, 225–226
See application file for complete search history.

(56) References Cited

U.S. PATENT DOCUMENTS 2,928,270 A * 3/1960 Olson ..... 68/199
3,595,916 A * 7/1971 O'Neil ..... 564/159
3,914,988 A * 10/1975 Avoy ..... 68/214
4,589,459 A * 5/1986 Lantrip ..... 150/166
8,434,173 B1 * 5/2013 Drew ..... 4/666

* cited by examiner

*Primary Examiner* — Lauren Crane
(74) *Attorney, Agent, or Firm* — IP Law Leaders PLLC

(57) ABSTRACT

A diaper retaining enclosure within which a soiled diaper may be retained while being rinsed. includes a generally planar base having parallel edges to which a pair of suitable hinges are secured. A pair of doors comprising generally planar flaps are secured to the hinges and are thus pivotable between an open position exposing the base and a closed "tented" position. The tented position is achieved by having the edges of the doors meet some distance away from the base in the closed position and thereby form a channel extending downwardly above the base and behind the doors. A clip is secured to the upper edge of the base and is configured to be spring-biased to a closed position. The resulting channel formed by the doors in the tented position is open at its top and bottom.

8 Claims, 14 Drawing Sheets

APPARATUS FOR RINSING DIAPERS

CROSS-REFERENCE TO RELATED APPLICATION

This application claims the benefit of and priority under 35 U.S.C. 119(e) of U.S. Provisional Patent Application No. 61/520,748, entitled APPARATUS FOR RINSING DIAPERS, filed Jun. 14, 2011 in the names of David J. Aprea and Jennifer K. Aprea, the disclosure of which is incorporated herein by reference.

FIELD OF THE INVENTION

This invention relates generally to diaper cleaning and handling methods and apparatus and particularly to apparatus for holding a soiled diaper during the initial rinse thereof.

BACKGROUND OF THE INVENTION

For many years, reusable cloth diapers have been utilized in swaddling infants prior to toilet training. Early on diapers were fabricated of a large square of absorbent cloth material which were secured to infants after having been folded into a triangular shape utilizing a plurality of safety pins. When such diapers became soiled with either urine or feces or both, diapers were initially rinsed in a toilet bowl and then subjected to a full laundering and sanitation. Such laundering and sanitation is often provided by contract services outside the home.

In the mid twentieth century, practitioners in the art developed a substantial number of disposable diapers which became extremely popular. Such disposable diapers are typically fabricated of a liquid impervious plastic outer lamination together with a plurality of absorbent interior layers of paper and batting. A variety of improvements have been made to disposable diapers to enhance their appeal and popularity. For the most part, the primary attraction of disposable diapers for users is the avoidance of the need to pre-rinse a soiled diaper prior to cleaning. The advantages of simply rolling up a soiled diaper and disposing of it in the trash are substantial.

Despite the convenience and popularity of disposable diapers, a substantial resurgence in the use of reusable cloth diapers has continued and increased. This resurgence has been energized largely by concerns for health and comfort of the infant and the more recently evolving concerns of waste management and ecology. The "green" movement within most of the industrialized nations of the world has motivated many individuals to seek to reduce and minimize the amount of trash which they create in their normal daily lives.

While the use of reusable diapers are believed to generally improve the comfort, health and sanitation of infants and to improve the ecology of the society, the situation remains that the use of such reusable diapers necessitates the often unpleasant task of pre-rinsing the soiled diaper in a toilet bowl prior to complete laundering.

SUMMARY OF THE INVENTION

The present invention APPARATUS FOR RINSING DIAPERS provides a diaper retaining enclosure within which a soiled diaper may be retained while being rinsed. The apparatus includes a generally planar base having parallel edges to which a pair of suitable hinges are secured. A pair of doors comprising generally planar flaps are secured to the hinges and are thus pivotable between an open position exposing the base and a closed "tented" position. The tented position is achieved by having the edges of the doors meet some distance away from the base in the closed position and thereby form a channel extending downwardly above the base and behind the doors. A clip is secured to the upper edge of the base and is configured to be spring-biased to a closed position. The resulting channel formed by the doors in the tented position is open at its top and bottom.

More specifically the present invention provides apparatus for use in rinsing diapers comprising: a generally planar base having a top portion, a bottom portion, a front surface and a pair of side edges; diaper clip means, secured to the base proximate the top portion, for securing a diaper to the base such that the remainder of the diaper extends downwardly upon the front surface; a pair of doors each pivotally secured to one of the side edges and each defining a door edge; and cooperating door engagements formed on the doors, the doors being pivotable from an open position exposing the front surface to a closed position in which the door engagements meet and the doors generally overlie a diaper on the front surface spaced therefrom to create a rinse channel between the doors and the front surface allowing rinse water to pass over a diaper on the front surface downwardly through the rinse channel or alternatively to an overlapping closed position in which the doors partially overlap to press against a diaper on the front surface to squeeze the diaper.

In operation, the apparatus is initially configured in a doors open configuration exposing the base and facilitating the installation of a soiled diaper against the base. Typically, the upper edge of the soiled diaper is secured with the spring-loaded clip and is allowed to extend downwardly upon the base. Thereafter, the doors are closed to the tented position and the apparatus supporting a soiled diaper therein is positioned above a toilet bowl. Finally, a handheld sprayer of the type well known in the art provides a stream of directed rinse water which the user applies from generally above and inwardly toward the soiled diaper. The rinse water then cascades down the soiled diaper carrying the soiled material with it into the toilet bowl. In accordance with an important aspect of the present invention, the doors in their tented position provide a splash confinement which avoids undue spray splash external to the diaper rinsing apparatus. Once the rinsing process has been completed, the doors are pivoted to their overlapping configuration in which the doors press the diaper against the base and in which the doors are pressed against the base against the diaper to squeeze excess water from the diaper. The doors are then moved to the open configuration and the clip is released allowing the rinsed and squeezed diaper to be removed.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

By way of overview, the present invention apparatus for rinsing diapers provides a convenient retainer within which a soiled diaper may be secured and maintained within the interior of a tented splash containing channel. The apparatus is provided by a generally planar base having a clip secured to the upper portion thereof. The clip is utilized in grasping the upper edge of a soiled diaper and allowing the diaper to hang downwardly overlying the base. The apparatus further includes a pair of hinged doors secured to the outer edges of the base and configured to be hingedly movable between an open position extending away from the base and a closed tented position extending inwardly above the base. In accordance with an important aspect of the present invention, the hinged doors meet at their outer edges in the tented configuration at a distance above or away from the base. This tented configuration provides a triangular shaped channel which extends from top to bottom of the soiled diaper and which is open at its top and bottom. This channel facilitates rinsing within the device as water is directed into the channel against the diaper. The open bottom facilitates the downward flow of rinse water and soiled material into a toilet bowl above which the apparatus is positioned during rinsing. The position of the pivoting doors in the tented configuration provides a splash protection which confines the spray to the channel interior of the apparatus thereby minimizing external spray and cleanup required.

Figure 1:
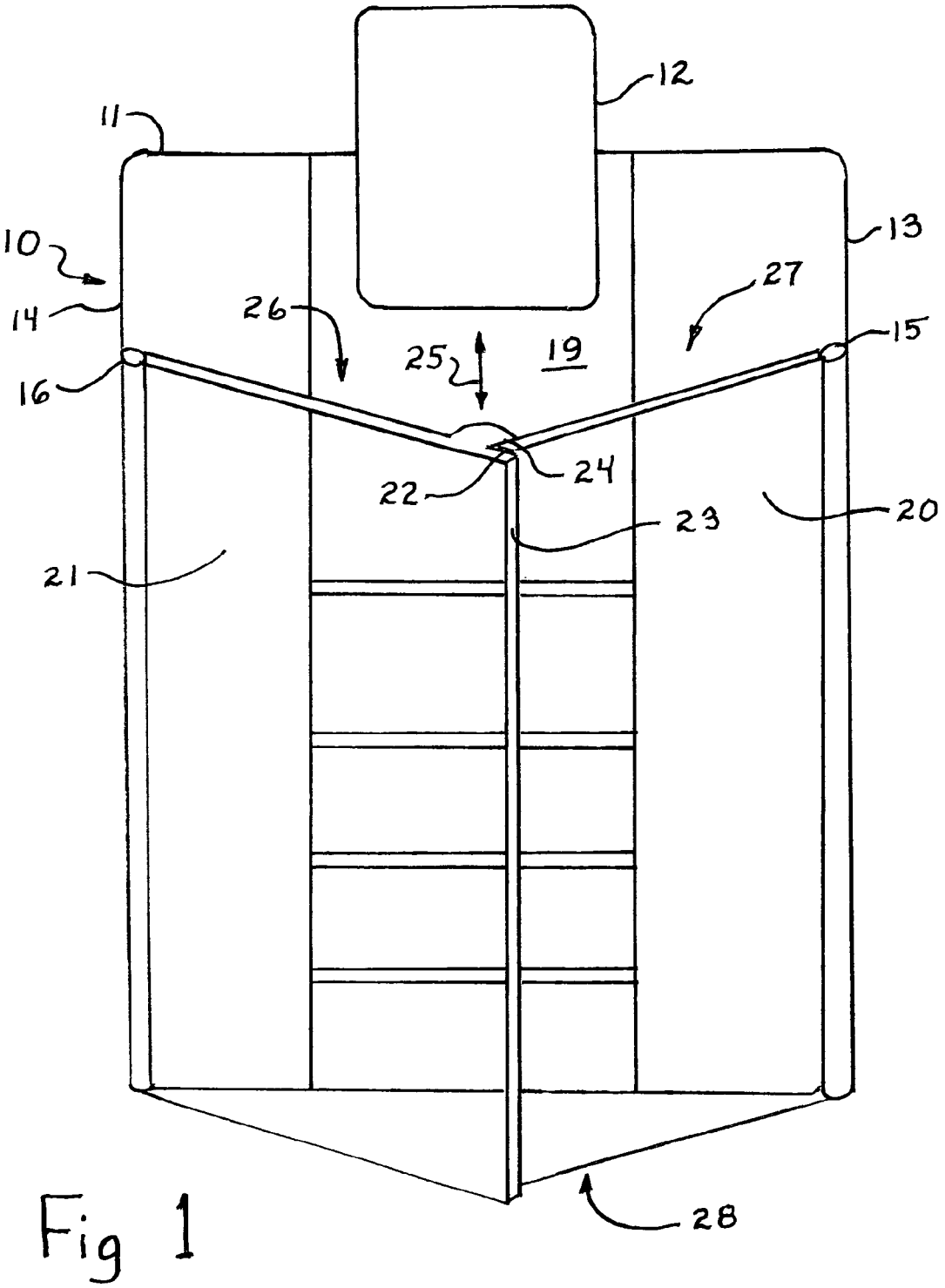
FIG. 1 sets forth a front perspective view of an apparatus for rinsing diapers constructed in accordance with the present invention in the doors closed "tented" configuration.

More specifically, FIG. 1 sets forth a front perspective view of the present invention apparatus for rinsing diapers in the closed door tented configuration which is generally referenced by numeral 10. It will be noted that Apparatus 10 is shown in FIGS. 1, 3, 4 and 7 as "transparent" to better reveal the present invention. Apparatus 10 includes a generally planar base 11 having a planar front surface 19, generally parallel edges 13 and 14. Base 11 further supports a clip 12 along the upper edge thereof. Edges 13 and 14 are joined to a pair of hinges 15 and 16. A pair of generally planar doors 20 and 21 are secured to hinges 15 and 16 and are movable between the tented configuration shown in FIG. 1 and the open configuration shown in FIG. 2. Door 20 defines a generally straight edge 22 while door 21 defines an edge 23 together with an offset lip 24. In the tented configuration shown in FIG. 1, edge 22 of door 20 is received behind edge 23 of door 21 and is positioned against lip 24. Hinges 15 and 16 are preferably fabricated in accordance with well known apparatus for spring loaded hinges in which hinges 15 and 16 have two preferred positions and spring urging therebetween. Thus, hinges 15 and 16 include conventional spring apparatus for forcing doors 20 and 21 to the tented configuration shown in FIG. 1. Additionally and with temporary reference to FIG. 2, it will be understood that hinges 15 and 16 define a stable open position in which the spring apparatus of hinges 15 and 16 urge doors 20 and 21 outwardly to the configuration shown in FIG. 2 once the spring force of hinges 15 and 16 has been overcome by pivoting doors 20 and 21 as indicated by arrows 30 and 31. In essence, the operation of hinges 15 and 16 provide two stable positions for doors 20 and 21, one of which is shown in FIG. 1 and the other of which is shown in FIG. 2.

Returning to FIG. 1 with doors 20 and 21 closed to the tented configuration, it will be noted that edges 22 and 23 of doors 20 and 21 respectively meet at a distance 25 spaced from the surface of base 11. This forms a triangular shaped channel 26 which extends downwardly from the open top thereof 27 and terminates at the lower end in an open bottom 28. The open character of channel 26 will be explained below in greater detail in FIG. 7. However, suffice it to note here that channel 26 having open top 27 and open bottom 28 allows water sprayed into channel 26 to freely fall downwardly exiting at open bottom 28 while being confined the tented configuration of doors 20 and 21.

Figure 2:
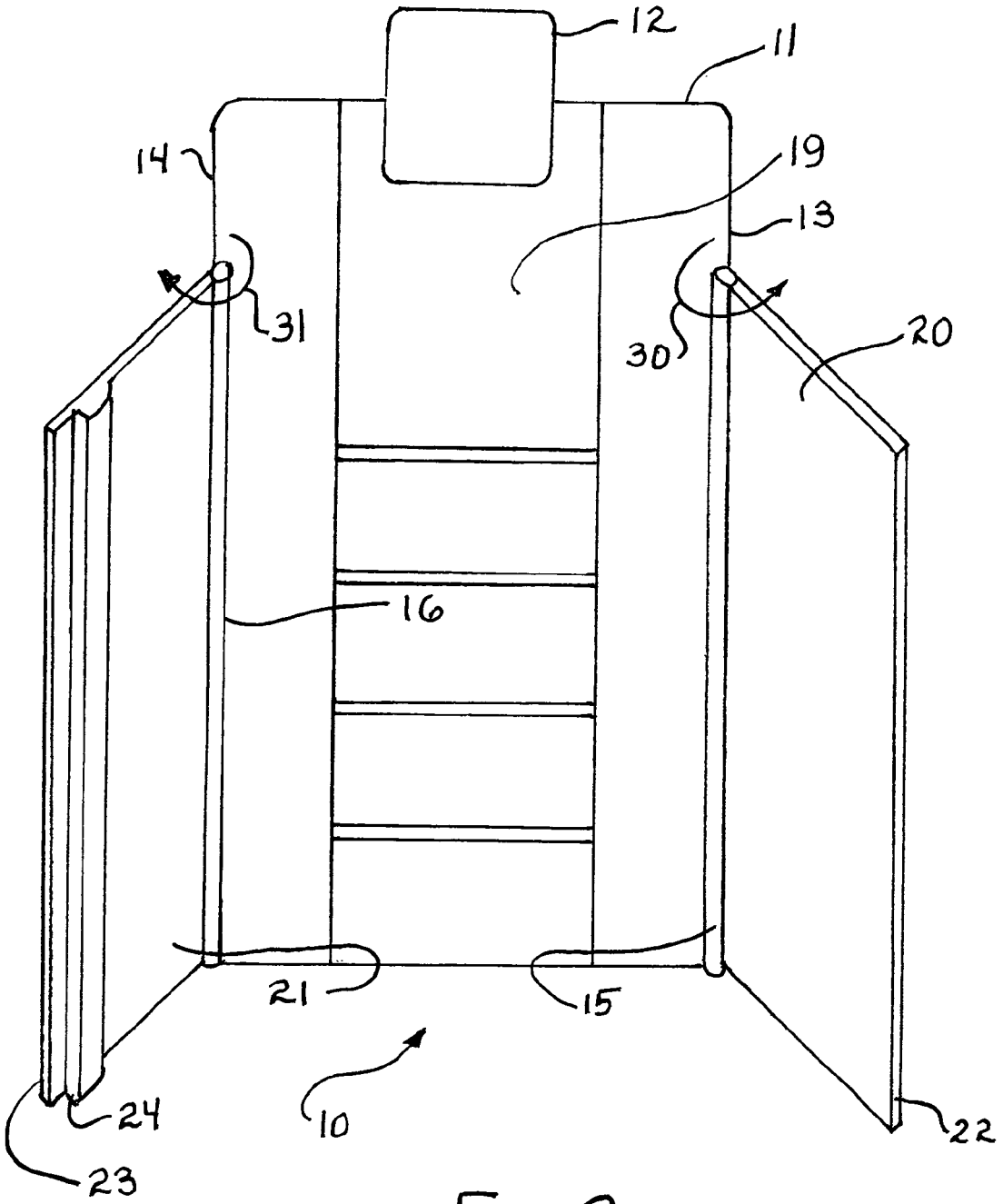
FIG. 2 sets forth a front perspective view of the present invention apparatus for rinsing diapers having the doors in the open configuration.

FIG. 2 sets forth a front perspective view of apparatus 10 in the open configuration of doors 20 and 21. As described above, apparatus 10 includes a generally planar base 11 having a generally planar front surface 19 supporting a spring clip 12 on its upper edge. As is also described above, apparatus 10 includes a pair of spring-biased bistable hinges 15 and 16 which in turn support a pair of movable doors 20 and 21. Door 20 defines a door edge 22 while door 21 defines a door edge 23 and an offset lip 24.

By simultaneous reference to FIGS. 1 and 2, it will be noted that apparatus 10 is transformed from the tented configuration shown in FIG. 1 to the open configuration shown in FIG. 2 by urging doors 20 and 21 to pivot outwardly in the direction indicated by arrows 30 and 31. As mentioned above, hinges 15 and 16 are in their preferred form spring-biased hinges which are utilized in providing a closing spring force which urges doors 20 and 21 toward the tented configuration shown in FIG. 1. Additionally, hinges 15 and 16 are fabricated to provide a "over-center" spring action in which the spring force of hinges 15 and 16 is operative as doors 20 and 21 are pivoted in the directions indicated by arrows 30 and 31 to move outwardly to the configuration shown in FIG. 2 thereby defining a second preferred position for the bistable spring-biased positioning of doors 20 and 21.

Figure 3:
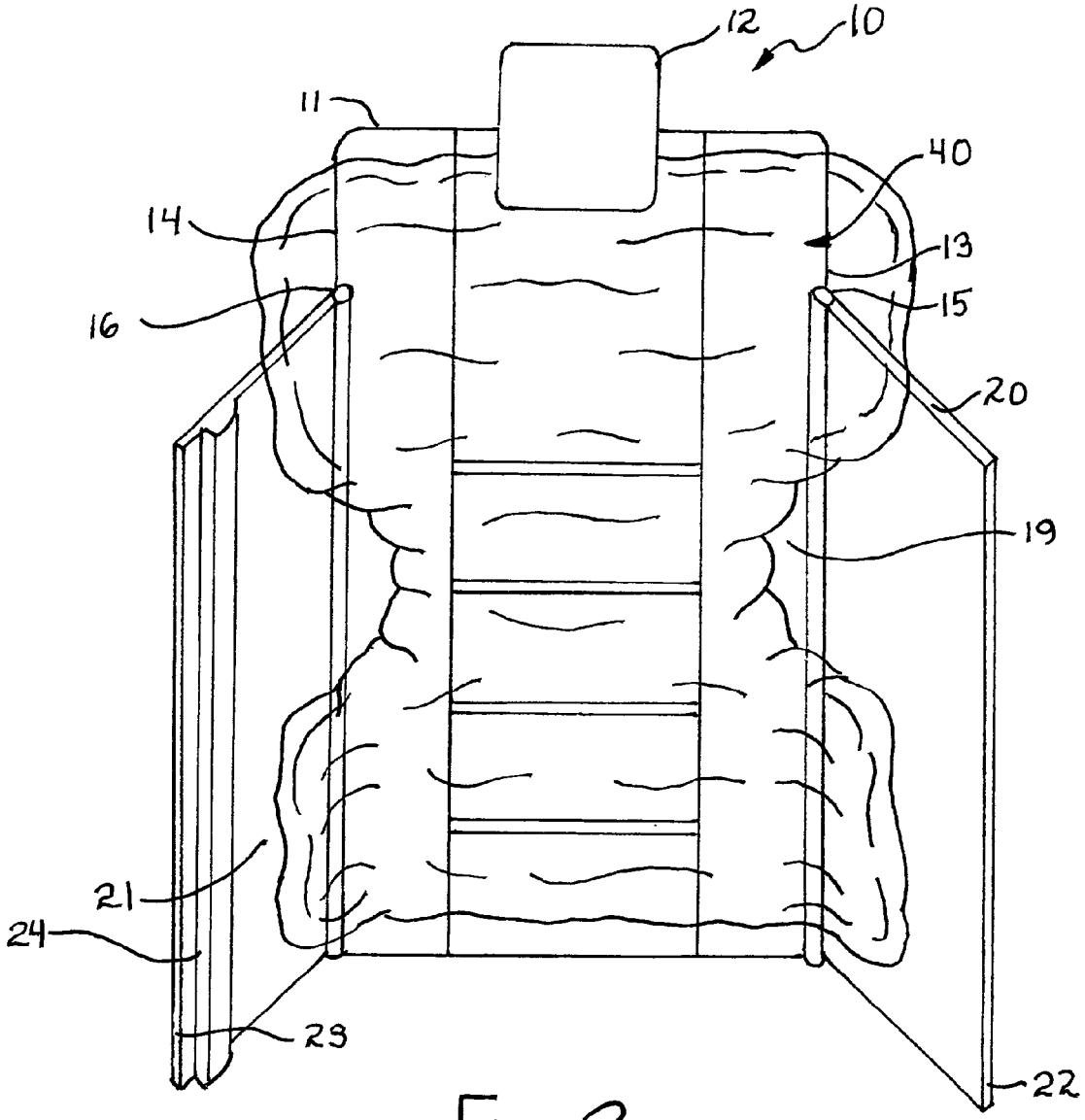
FIG. 3 sets forth a front perspective view of the present invention apparatus for rinsing diapers having the doors in the open configuration and supporting a diaper upon the base portion.

FIG. 3 sets forth apparatus 10 in the open configuration shown above in FIG. 2 further supporting a typical soiled diaper 40. Thus, as described above, apparatus 10 includes a generally planar base 11 having a front surface 19 and supporting hinges 15 and 16 along edges 13 and 14 thereof. Hinges 15 and 16 further support doors 20 and 21 for pivotal movement between the open position shown in FIG. 3 and the tented position shown in FIG. 1. As is also described above, door 20 defines an edge 22 while door 21 defines an edge 23 and an offset lip 24.

Figure 4:
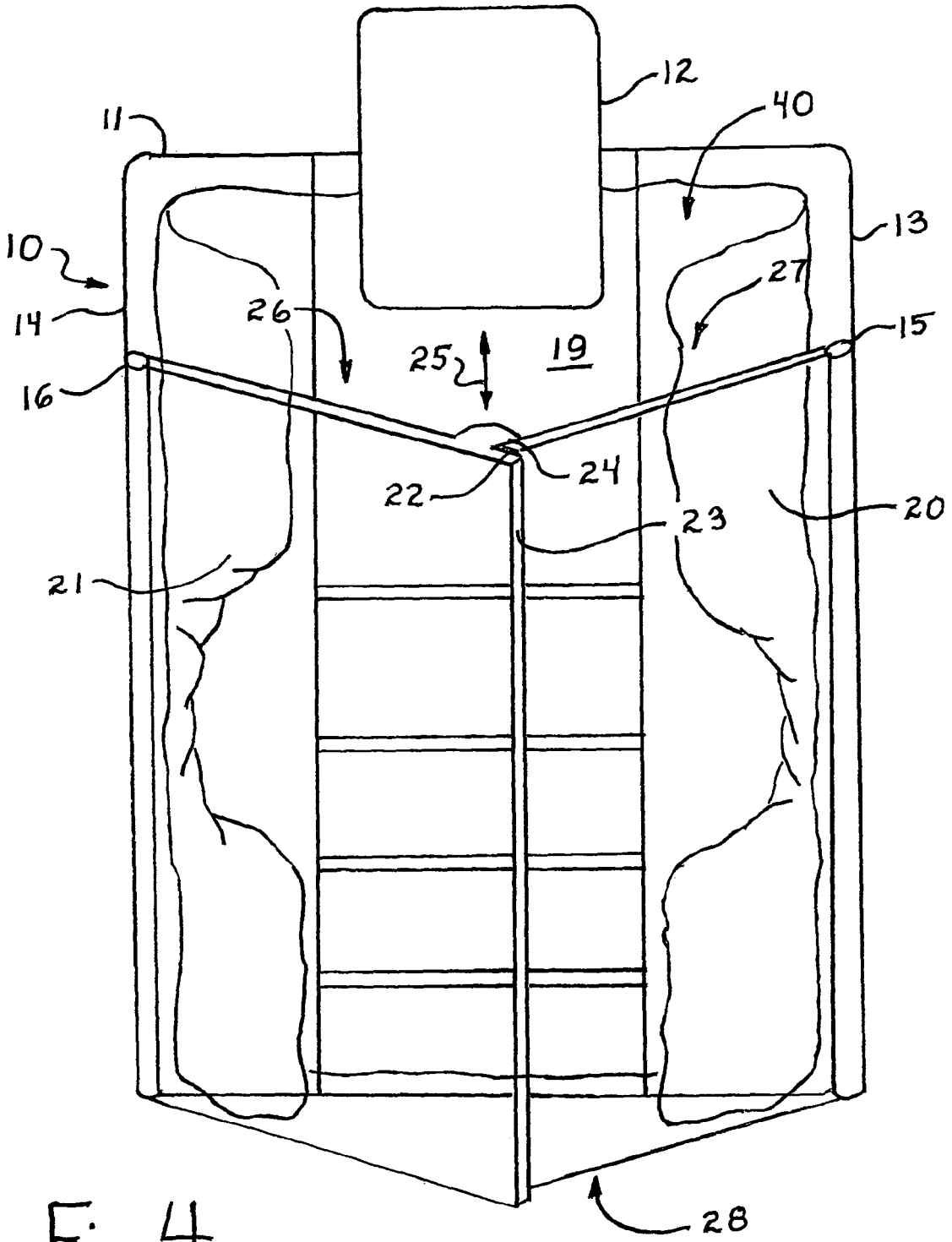
FIG. 4 sets forth a front perspective view of the present invention apparatus for rinsing diapers having the doors configured in the closed tented configuration and confining a diaper within the apparatus.
Figure 5:
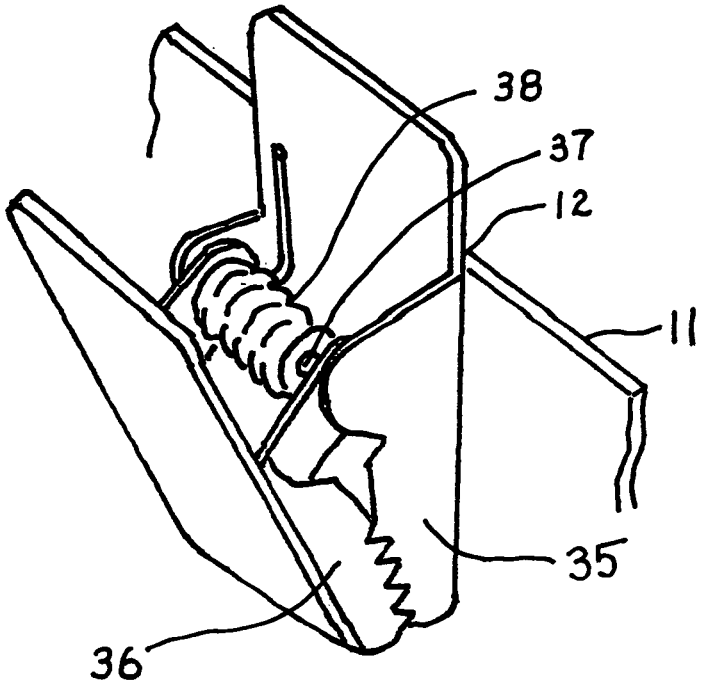
FIG. 5 sets forth a partial perspective view of the diaper clip of the present invention apparatus for rinsing diapers.
Figure 6:
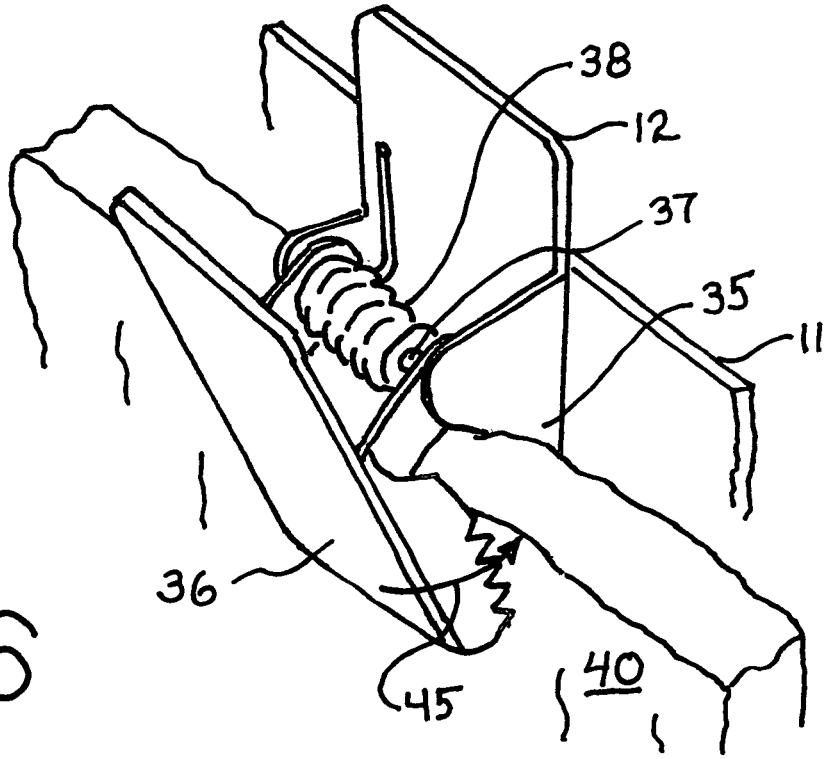
FIG. 6 sets forth a partial perspective view of the diaper clip of the present invention apparatus for rinsing diapers engaging the upper edge of a typical diaper.

In the open configuration shown in FIG. 3, a soiled diaper 40 is secured against front surface 19 of base 11 along its top edge by the gripping action of clip 12 (set forth in FIGS. 5 and 6 in greater detail). With clip 12 securing the upper edge of diaper 40, the remainder of soiled diaper 40 extends downwardly resting upon base 11 between open doors 20 and 21. At this point, the user then pivots doors 20 and 21 inwardly to the tented configuration shown in FIG. 4 in which diaper 40 is captivated.

FIG. 4 sets forth a front perspective view of apparatus 10 having a soiled diaper 40 captivated therein. As mentioned above, apparatus 10 includes a generally planar base 11 supporting a clip 12 and a pair of spring-biased bistable hinges 15 and 16. Hinges 15 and 16 support doors 20 and 21. In the tented configuration shown in FIG. 4, edge 22 of door 20 rests against lip 24 formed in door 21. Conversely, door 21 is urged against edge 22 of door 20 by the inwardly directed spring force actions of hinges 15 and 16. Thus, as shown in FIG. 4, apparatus 10 in its closed tented configuration confines soiled diaper 40 within channel 26. Open top 27 and open bottom 28 of channel 26 function in the manner set forth below in FIG. 7 to allow spray water to be directed against soiled diaper 40 and to descend downwardly into a toilet bowl.

FIG. 5 sets forth a perspective view of clip 12 supported upon the upper edge of base 11. It will be apparent to those skilled in the art that clip 12 is, in essence, a large "alligator" clip of a type frequently used in the art. In the embodiment of the invention shown in FIG. 5, clip 12 includes a fixed jaw 35 joined to the upper portion of base 11 by suitable attachment such as conventional fasteners or adhesive attachment or the like. Clip 12 further includes a movable jaw 36 pivotally secured to fixed jaw 35 by a shaft 37. A conventional spring 38 is received upon shaft 37 and provides a spring force which urges jaw 36 toward jaw 35 in the closed position shown in FIG. 5. It will be apparent to those skilled in the art that a variety of clips and clamping mechanisms may be utilized to secure diaper 40 in the manner shown in FIG. 4 without departing from the spirit and scope of the present invention.

FIG. 6 sets forth a partial perspective view of base 11 supporting clip 12 in which clip 12 is operative to grasp the upper edge of a soiled diaper 40. As described above, clip 12 includes a fixed jaw 35 secured to base 11 and a movable jaw 36. Movable jaw 36 and fixed jaw 35 are pivotally joined by a shaft 37. A spring 38 urges movable jaw 36 toward fixed jaw 35 in the direction indicated by arrow 45. In so doing, jaw 36 grasps the upper edge of diaper 40 holding it against fixed jaw 35 and maintaining its position. Once again, it will be apparent to those skilled in the art that a substantial variety of clips and clamping mechanisms may be utilized to grasp diaper 40 without departing from the spirit and scope of the present invention.

Figure 7:
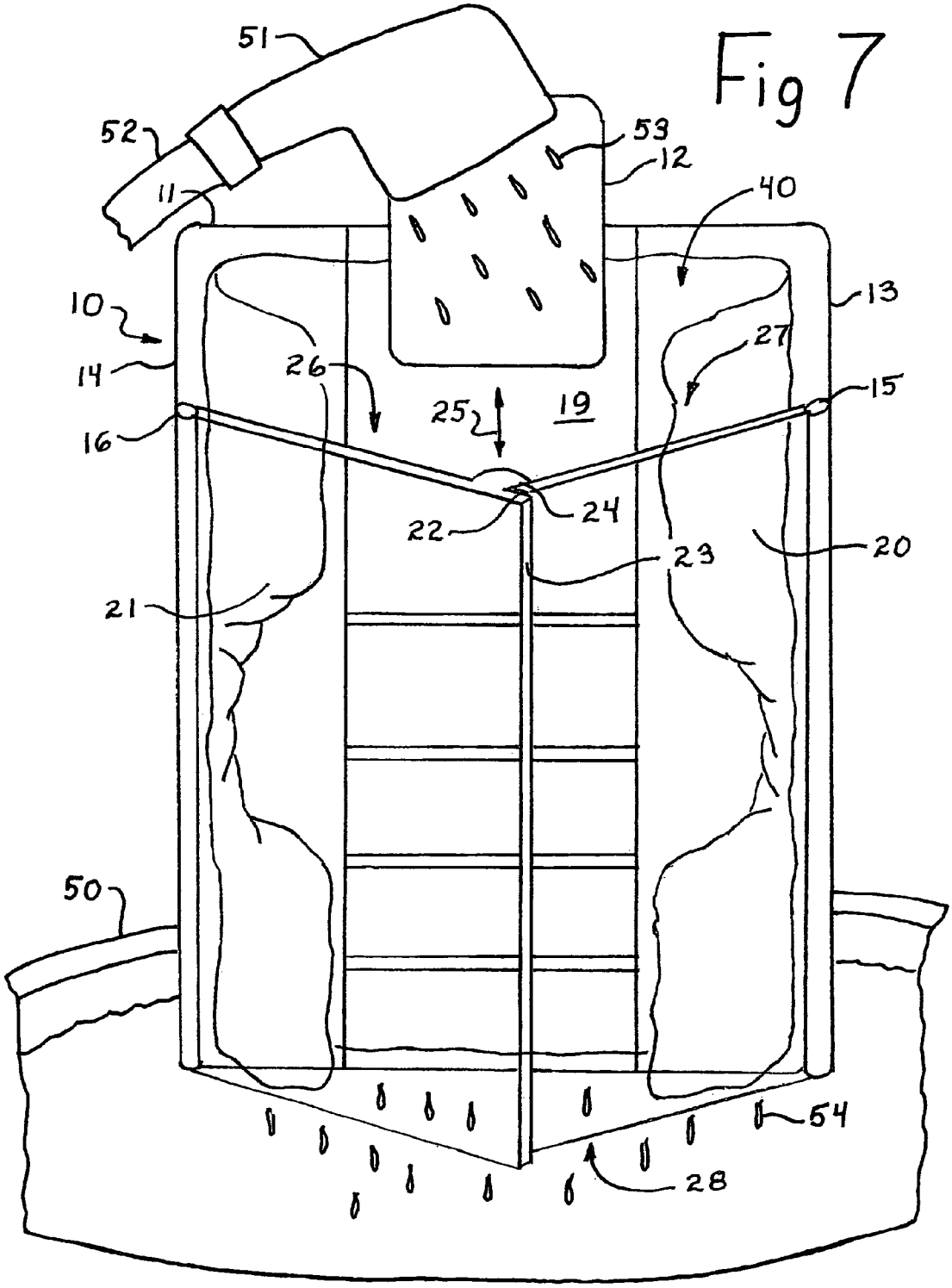
FIG. 7 sets forth a front perspective view of the present invention apparatus for rinsing diapers containing a soiled diaper and utilizing a typical rinsing operation.
Figure 8:
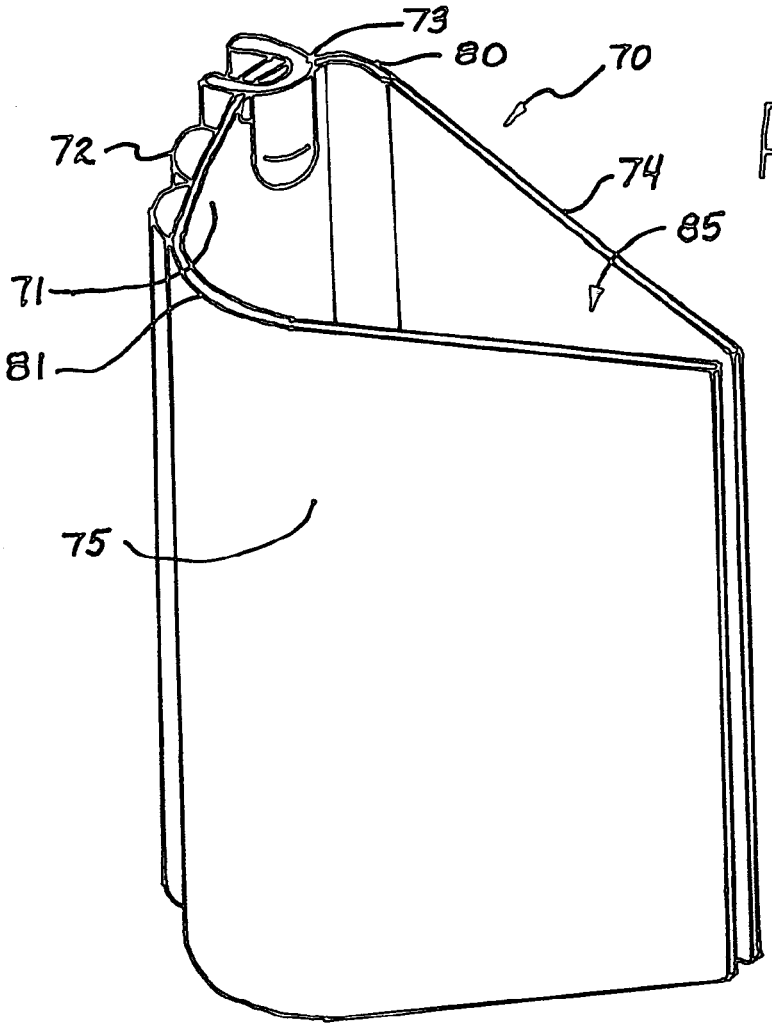
FIG. 8 sets forth a perspective view of an alternate embodiment of the present invention apparatus for rinsing diapers.

FIG. 7 sets forth a perspective view of the present invention apparatus supporting a soiled diaper above a toilet bowl and subjected to a handheld sprayer for rinsing action. As mentioned above, apparatus 10 includes a generally planar base 11 supporting a clip 12 together with a pair of hinges 15 and 16. As is also mentioned above, hinges 15 and 16 further support doors 20 and 21. In accordance with the present invention apparatus and method, apparatus 10 is configured with doors 20 and 21 closed to their tented configurations in which edge 22 of door 20 is received against lip 24 of door 21. Further, edge 23 of door 21 extends beyond and rests against edge 22 of door 20. Thus in this configuration, apparatus 10 forms a channel 26 having an open top 27 and an open bottom 28 within which a soiled diaper 40 is confined. In further accordance with the above-described apparatus, clip 12 engages and secures the upper portion of soiled diaper 40 against base 11.

A handheld sprayer 51 is coupled to a hose 52 which in turn is connected to a water supply (not shown). Sprayer 51 and connecting hose 52 are fabricated in accordance with conventional fabrication techniques and are known widely in the art. Of importance to note is that hose 52 couples sprayer head 51 to a source of water under pressure such that a water spray 53 emanates from sprayer 51. In further accordance with the utilization of the present invention, apparatus 10 supporting soiled diaper 40 is positioned above a conventional toilet bowl 50.

In operation as the user manipulates sprayer head 51 to direct a water spray 53 against diaper 40 and into open top 27 of channel 26, water flows downwardly against the surface of diaper 40 carrying the soiled material downwardly and flowing outwardly as outflow 54 through open bottom 28. Outflow 54 carrying the solid and liquid waste within soiled diaper 40 flows downwardly into toilet bowl 50 for eventual disposal. In accordance with the present invention, sprayer head 51 may be moved into channel 26 as desired during which time spray 53 is confined within channel 26 by the tented position of doors 20 and 21. Additionally, the secure attachment of diaper 40 provided by clip 12 against base 11 further enhances the user's ability to simultaneously hold the combination of apparatus 10 and diaper 40 in one hand while manipulating sprayer 51 with the remaining hand. Once the user has satisfactorily rinsed the interior of diaper 40 and allowed the outflow to descend into toilet bowl 50, the user terminates spray operation and closes doors 20 and 21 to the overlapping configuration shown in FIG. 12 and the doors are squeezed against base 11 to expel excess water from diaper 40. After a brief shake to drop residual water from the interior of apparatus 10 and diaper 40 the user then opens doors 20 and 21 and thereafter opens clip 12 to free diaper 40. The user then has a rinsed which may be wrung out and which may be put aside for further sanitizing and laundering.

In the preferred fabrication of the present invention, apparatus 10 is formed of molded elements joined by hinges 15 and 16. Apparatus 10 may be formed of molded silicone and/or molded plastic. However, it will be recognized by those skilled in the art that doors 20 and 21 as well as base 11 and clip 12 may be fabricated from a variety of materials to suit the user's preferences and needs. By way of further variation, FIGS. 8 through 11 set forth an alternate embodiment of the present invention fabricated as a single integrally formed molded silicone or plastic unit.

Accordingly, FIGS. 8 through 11 show apparatus 70 having a molded one-piece unit providing a base and a pair of doors pivotally joined to the base by a pair of molded "living hinges" and a spring clip on the upper edge of the base. The molded embodiment functions in the same manner as the embodiment set forth and described in FIGS. 1 through 8.

More specifically, apparatus 70 includes a base 71 defining a generally planar member having a plurality of vertical ribs 72 formed on its rear surface. A pair of hinges 80 and 81 extend from the sides of base 70 and further support a pair of doors 74 and 75. Doors 74 and 75 are generally planar and terminate in edges 76 and 77 respectively. As is better seen in FIG. 9 below, edges 76 and 77 are preferably constructed to meet in the closed configuration of apparatus 70. Apparatus 70 further includes a clip 73 formed in the upper edge of base 71. The structure of clip 73 is set forth below in greater detail (seen in FIG. 11). However, suffice it to note here that clip 73 functions in a similar manner to clip 12 as shown in FIG. 6 to grip the upper edge of a soiled diaper. In accordance with an important aspect of the present invention, it will be noted that doors 74 and 75 form a "tented" closure similar to doors 20 and 21 of apparatus 10 shown and described above (see for example FIG. 7). This tented closure defines a channel 85 formed by the triangular combination of base 71, door 74 and door 75. In accordance with the rinsing operation shown above in FIG. 7, rinse water flows downwardly through channel 85 carrying soiled material out through the bottom of apparatus 70.

Figure 9:
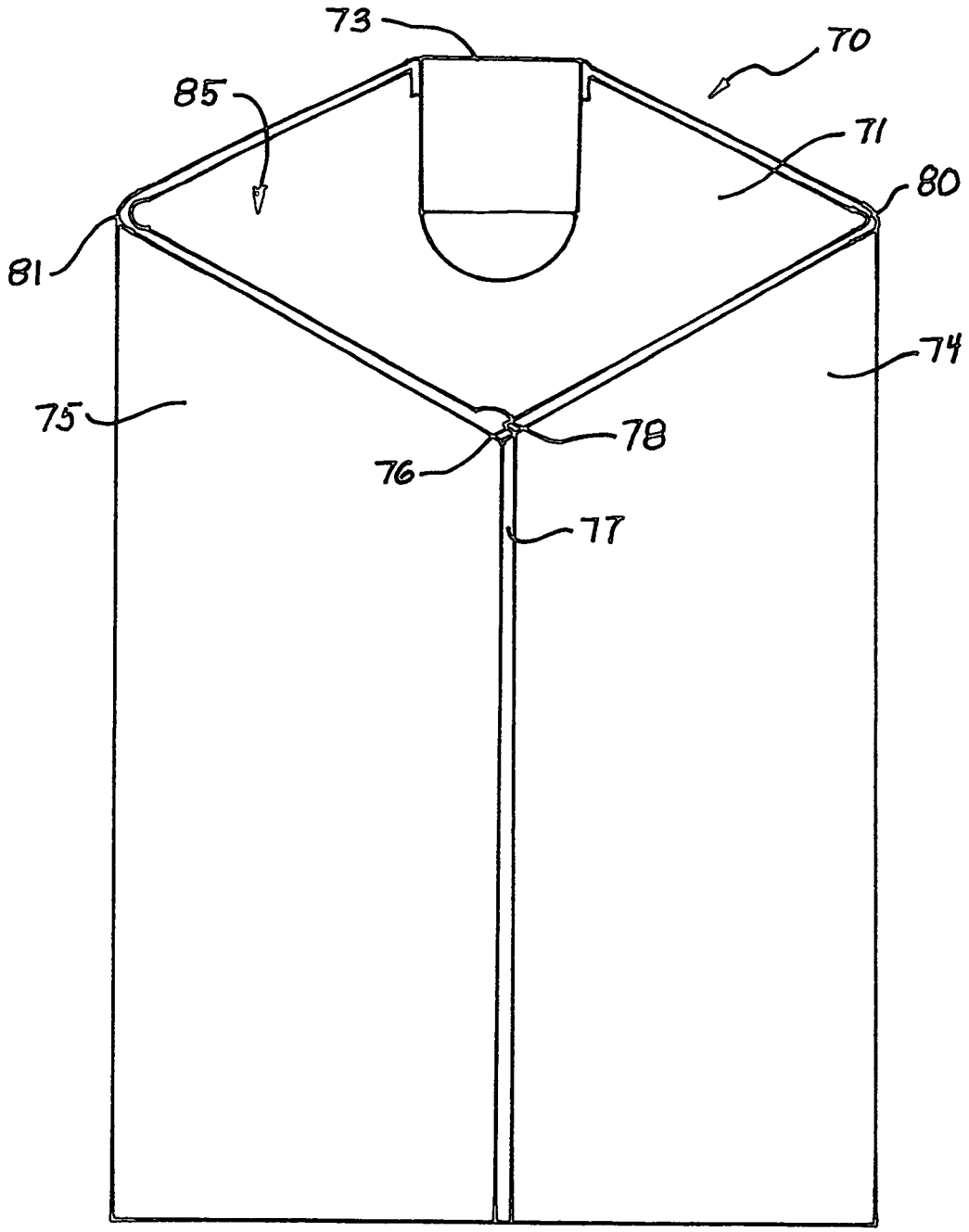
FIG. 9 sets forth a front view of the embodiment of FIG. 8 in its closed configuration.

FIG. 9 sets forth a front view of apparatus 70 in its closed configuration. As mentioned above, the closed configuration of apparatus 70 actually forms a tented structure in which a triangular channel 85 extends downwardly between doors 74 and 75 and base 71. During the diaper rinsing operation described above in FIG. 7, a diaper held by clip 73 within channel 85 is rinsed by water spray falling through channel 85. The edge closure provided by edges 76 and 77 together with lip 78 creates a splash-confining shield to confine the rinse water and protect the area surrounding the apparatus.

More specifically, as described above, apparatus 70 includes a base 71 supporting a clip 73 and a pair of molded hinges 80 and 81. A pair of doors 74 and 75 are pivotally supported by hinges 80 and 81 respectively. Hinges 80 and 81 provide a spring force which urges doors 74 and 75 toward the closed configuration shown in FIG. 9. This spring force maintains closure of doors 74 and 75. Apparatus 70 is opened to receive a soiled diaper by simply forcing doors 74 and 75 apart overcoming the spring force of hinges 80 and 81 and configuring apparatus 70 as shown in FIG. 10.

Figure 10:
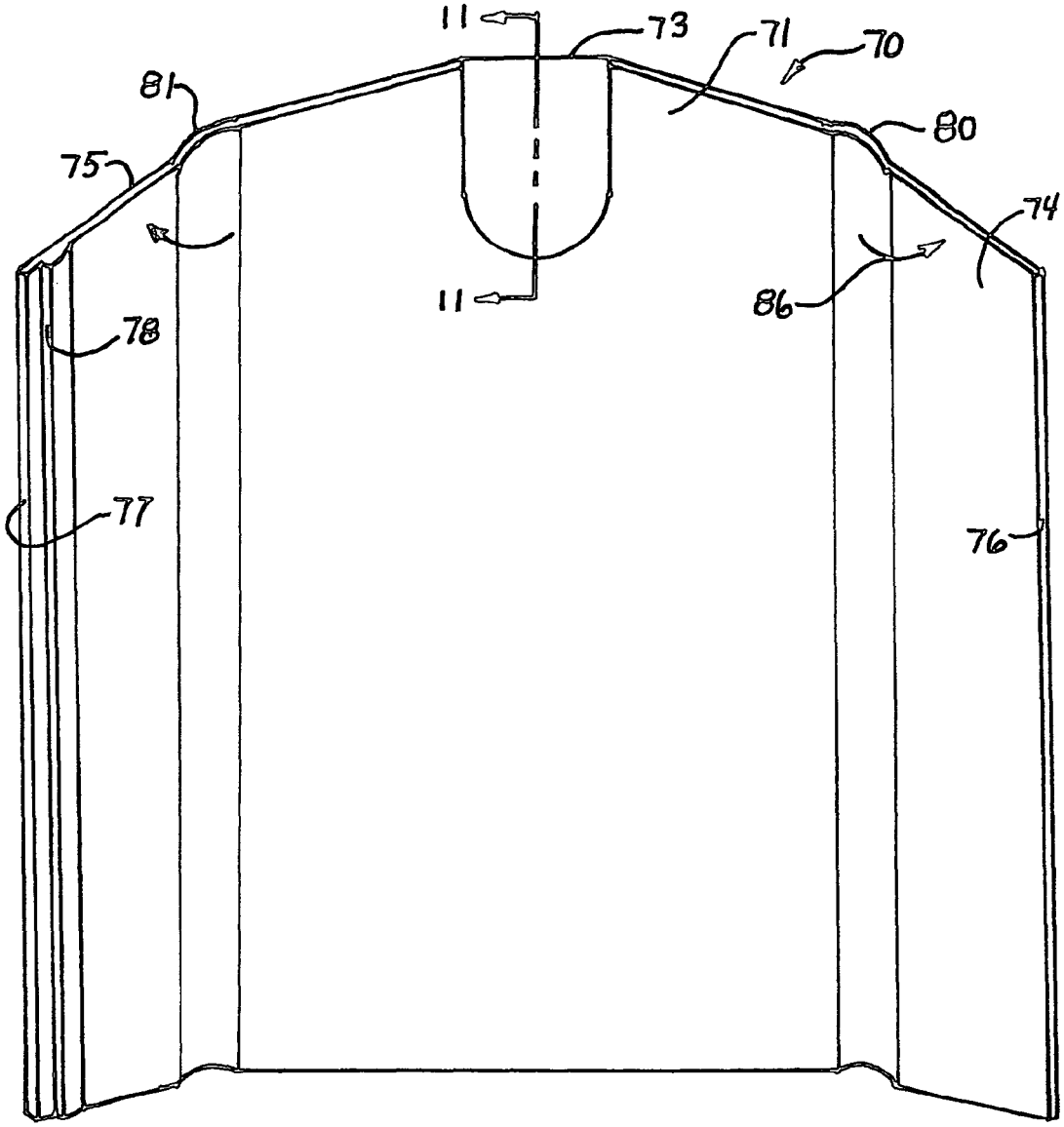
FIG. 10 sets forth a front view of the embodiment of FIG. 9 in its open configuration.

FIG. 10 sets forth a front view of apparatus 70 in its open configuration. As described above, apparatus 70 includes a base 71 supporting a clip 73 and a pair of molded hinges 80 and 81. A pair of doors 74 and 75 are pivotally supported by hinges 80 and 81 respectively. Hinges 80 and 81 provide a spring force which urges doors 74 and 75 toward the closed configuration shown in FIG. 9. This open configuration is obtained by forcing doors 74 and 75 outwardly in the directions indicated by arrows 86 and 87. With doors in this open configuration, a soiled diaper may be placed upon base 71 and secured thereto by clip 73. Thereafter, doors 74 and 75 are released allowing the spring forces of hinges 80 and 81 to pivot doors 74 and 75 to the closed configuration shown in FIG. 9.

Figure 11:
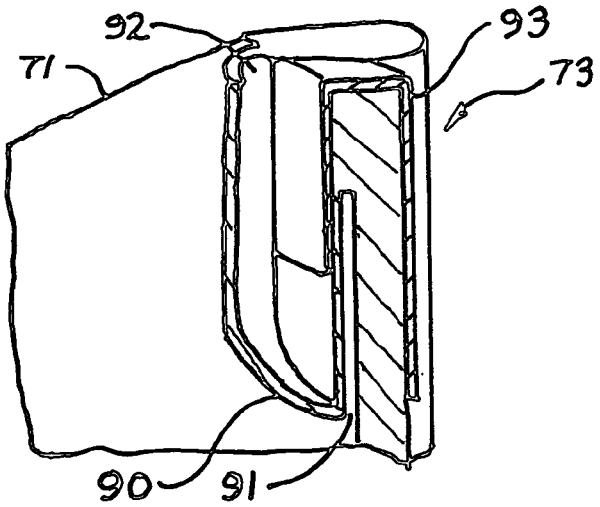
FIG. 11 sets forth a partial section view of clip mechanism 73.

FIG. 11 sets forth a section view of apparatus 70 taken along section line 11-11 in FIG. 10. Clip 73 is formed as an integral part of base 71. A cantilevered member 90 extends downwardly from the upper edge of base 71. A slot 91 separates the lower portion of member 90 from the surface of base 71 thereby forming the cantilevered structure of member 90. While the resilience of the plastic material from which apparatus 71 is formed provides a spring action to member 90, an improved gripping action is imparted to clip 73 by adding a generally U-shaped steel spring. In this manner, clip 73 functions to grasp the upper edge of a soiled diaper during rinsing. Member 90 also defines a receptacle 92 which is used by the user in holding apparatus 70 to easily manipulate clip 73 during rinsing. The user is able to insert a thumb into receptacle 92 while extending the user's fingers down the rear surface of base 71. Movement of the user's thumb away from base 71 opens clip 73. Conversely, inward pressure of the thumb adds to the force of spring 93 grasping the diaper more tightly. Once the diaper is rinsed, the user moves doors 74 and 75 to an overlapping configuration similar to doors 20 and 21 of apparatus 10 as is shown below in FIG. 12. The user then squeezes doors 74 and 75 against base 71 after which doors 74 and 75 are opened to the configuration shown in FIG. 10 and releases the diaper by forcing outwardly within receptacle 92.

Figure 12:
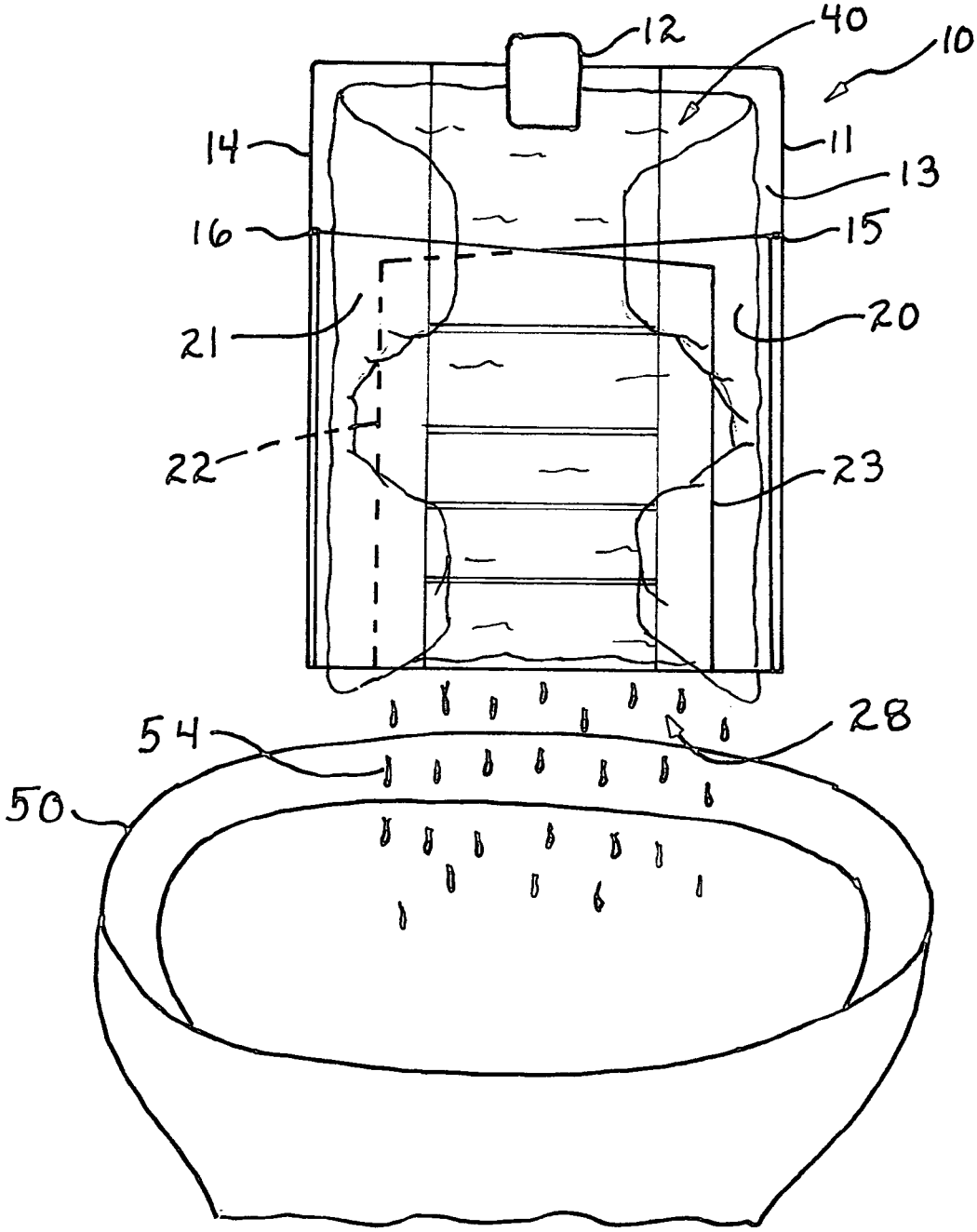
FIG. 12 sets forth a front view of the embodiment of FIG. 7 having the doors thereof in the overlapping configuration.

FIG. 12 sets forth a front view of apparatus 10 having doors 20 and 21 in the overlapping configuration used to squeeze excess water from diaper 40 following spray-rinsing as described above in FIG. 7. It will be apparent to those skilled in the art that apparatus 70, shown in FIGS. 8 through 11, functions in a similar manner to move doors 74 and 75 to an overlapping configuration. Thus, it will be understood that the descriptions of excess water squeezing described for apparatus 10 apply equally well to apparatus 10.

More specifically, as described above, apparatus 10 includes a base 11 having doors 20 and 21 pivotally secured thereto by a pair of hinges 15 and 16 respectively. Diaper 40 is secured against base 11 by clip 12. Doors 20 and 21 are pivoted to an overlapping configuration captivating diaper 40. Excess water is squeezed from diaper 40 following the above-described rinsing process by squeezing doors 20 and 21 against base 11. Excess water flow 54 flows downwardly from bottom 28 into toilet 50. Once excess water has been squeezed from diaper 40, doors 20 and 21 are opened and diaper 40 may be removed from apparatus 10.

Figure 13:
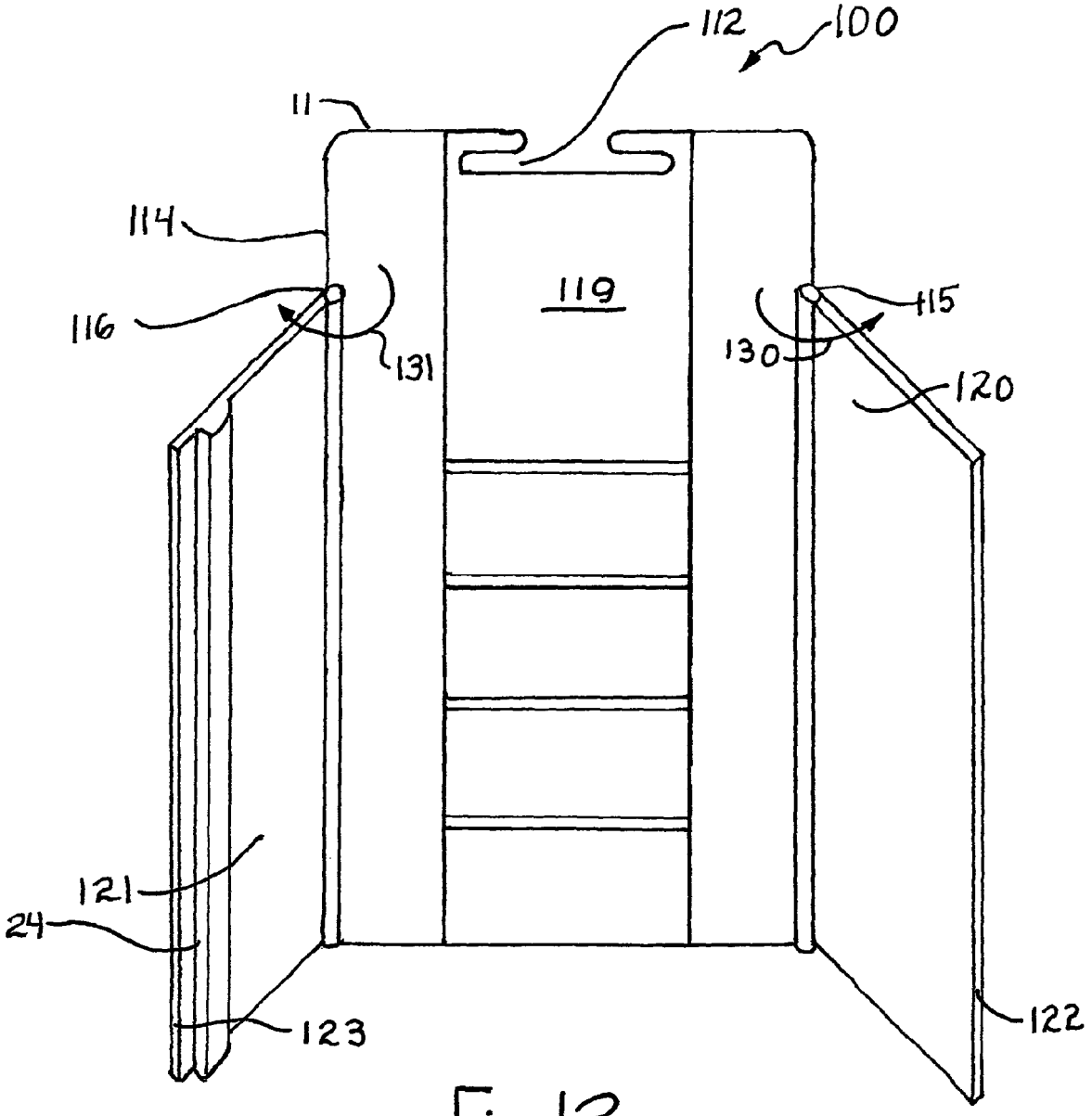
FIG. 13 sets forth a perspective view of a further alternate embodiment of the present invention apparatus for rinsing diapers.

FIG. 13 sets forth a front perspective view of an alternate embodiment of the present invention apparatus generally referenced by numeral 100. Apparatus 100 is substantially identical to apparatus 10 set forth above with the exception of clip 12 being removed and replaced by a slot 112 which is used in place of a clip to secure the upper edge of a diaper to the base. Apparatus 100 includes pivotable doors supported by hinges 115 and 116. Apparatus 100 is shown in the open configuration of doors 120 and 121. Apparatus 100 includes a generally planar base 111 having a generally planar front surface 119 and a diaper-retaining slot 112 on its upper edge. Apparatus 100 includes a pair of spring-biased bistable springs within hinges 115 and 116 which in turn urge movable doors 120 and 121 toward closure as indicated by arrows 130 and 131.

Figure 14:
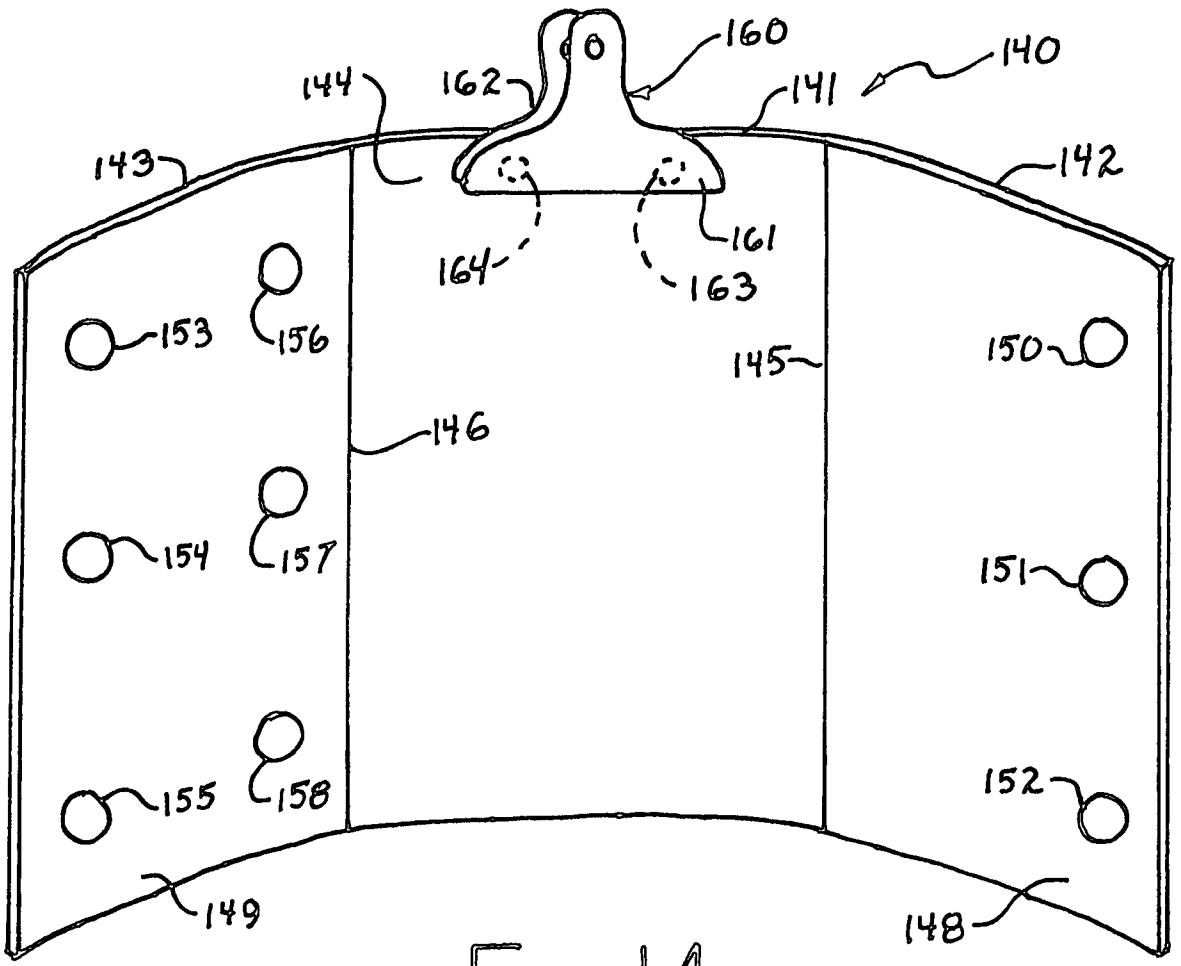
FIG. 14 sets forth a front perspective view of a still further alternate embodiment of the present invention apparatus for rinsing diapers having the doors in the open configuration.

FIG. 14 sets forth a front perspective view of a still further alternate embodiment of the present invention apparatus for rinsing diapers generally referenced by numeral 140. Apparatus 140 is constructed in a similar structure to the embodiments describer above and thus will be understood to function in the same general manner. Apparatus 140 differs in that the back and doors thereof are formed of a single thin relatively flexible sheet of plastic material, or the like. Apparatus 140 is shown in a doors-open configuration suitable for initially receiving a soiled diaper.

More specifically, apparatus 140 includes a back 141, a door 142 and a door 143. A pair of hinge lines 145 and 146 join doors 142 and 143 respectively to back 141. Doors 142 and 143 define interior surfaces 148 and 149 respectively while back 141 defines interior surface 144. In the preferred fabrication of the present invention, hinge lines 145 and 146 are living hinges formed by reducing the material thickness along the hinge lines. Thus, doors 142 and 143 pivot about hinge lines 145 and 146 between the open configuration shown in FIG. 14, the tented configuration shown in FIG. 15 and the closed configuration shown in FIG. 16.

Apparatus 140 further includes a clip 160 having a fixed member 162 and a movable member 161. Clip 160 is fabricated in accordance with general fabrication techniques and includes a spring (not shown) which forces movable member against fixed member 162 to grasp a diaper and hold it during rinsing. Clip 160 is secured to back 141 by a pair of conventional rivets 163 and 164. Door 142 supports a trio of snap fasteners 150, 151 and 152. Door 143 supports a trio of snap fasteners 153, 154 and 155 along the outer edge of door 143. Door 143 further supports a second trio of snap fasteners 156, 157 and 158 near hinge line 146. Snap fasteners 150 through 158 are oriented such that snap fasteners 150 through 152 may attach to snap fasteners 153 through 155 respectively to form the tented configuration of FIG. 15 or, alternatively, may attach to snap fasteners 156 through 158 respectively to form the closed configuration of FIG. 16.

Figure 15:
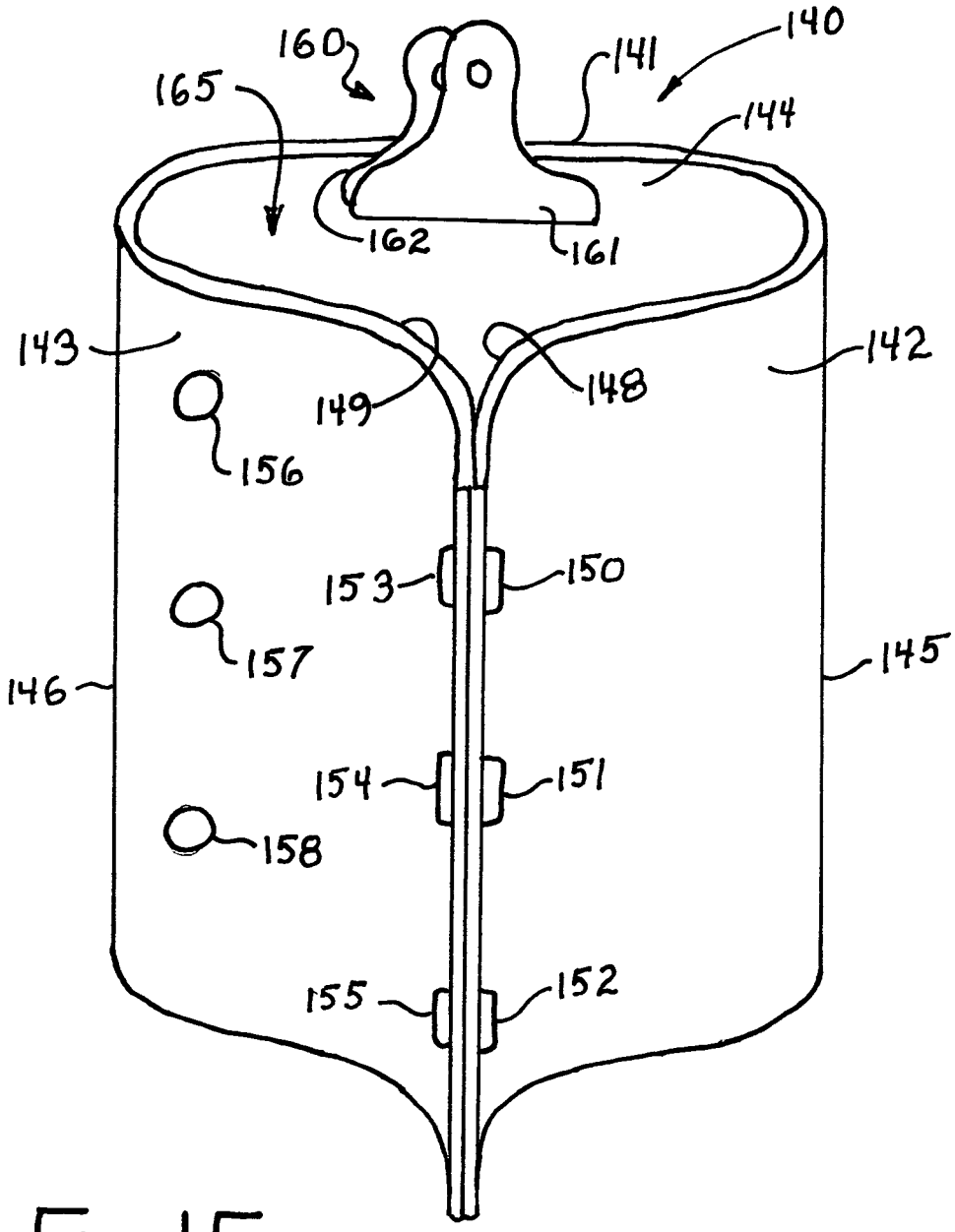
FIG. 15 sets forth a front perspective view of the embodiment show in FIG. 14 in its tented configuration.

FIG. 15 shows apparatus 140 in the tented configuration. Of importance to note is the formation of a rinsing channel 165 which aids in flowing rinse water over a soiled diaper in the manner set forth above in FIG. 7.

More specifically, and as is described above, apparatus 140 includes a back 141, a door 142 and a door 143. A pair of hinge lines 145 and 146 join doors 142 and 143 respectively to back 141. In the preferred fabrication of the present invention, hinge lines 145 and 146 are living hinges formed by reducing the material thickness along the hinge lines. Doors 142 and 143 are pivoted about hinge lines 145 and 146 to the tented configuration. Clip 160 is secured to back 141 by a pair of conventional rivets 163 and 164. Door 142 supports a trio of snap fasteners 150, 151 and 152. Door 143 supports a trio of snap fasteners 153, 154 and 155 along the outer edge of door 143. Door 143 further supports a second trio of snap fasteners 156, 157 and 158 near hinge line 146.

In the tented configuration shown in FIG. 15, doors 142 and 143 are brought together such that surfaces 148 and 149 are together near the door edges. Snap fasteners 150 through 152 engage snap fasteners 153 through 155 and channel 165 is formed. With a soiled diaper held within channel 165 against back surface 144, the rinsing action shown above in FIG. 7 may be carried forward. Once the diaper is rinsed, snap fasteners 150 through 15152 are separated from snap fasteners 153 through 155 and apparatus 140 is configured in the manner shown in FIG. 16.

Figure 16:
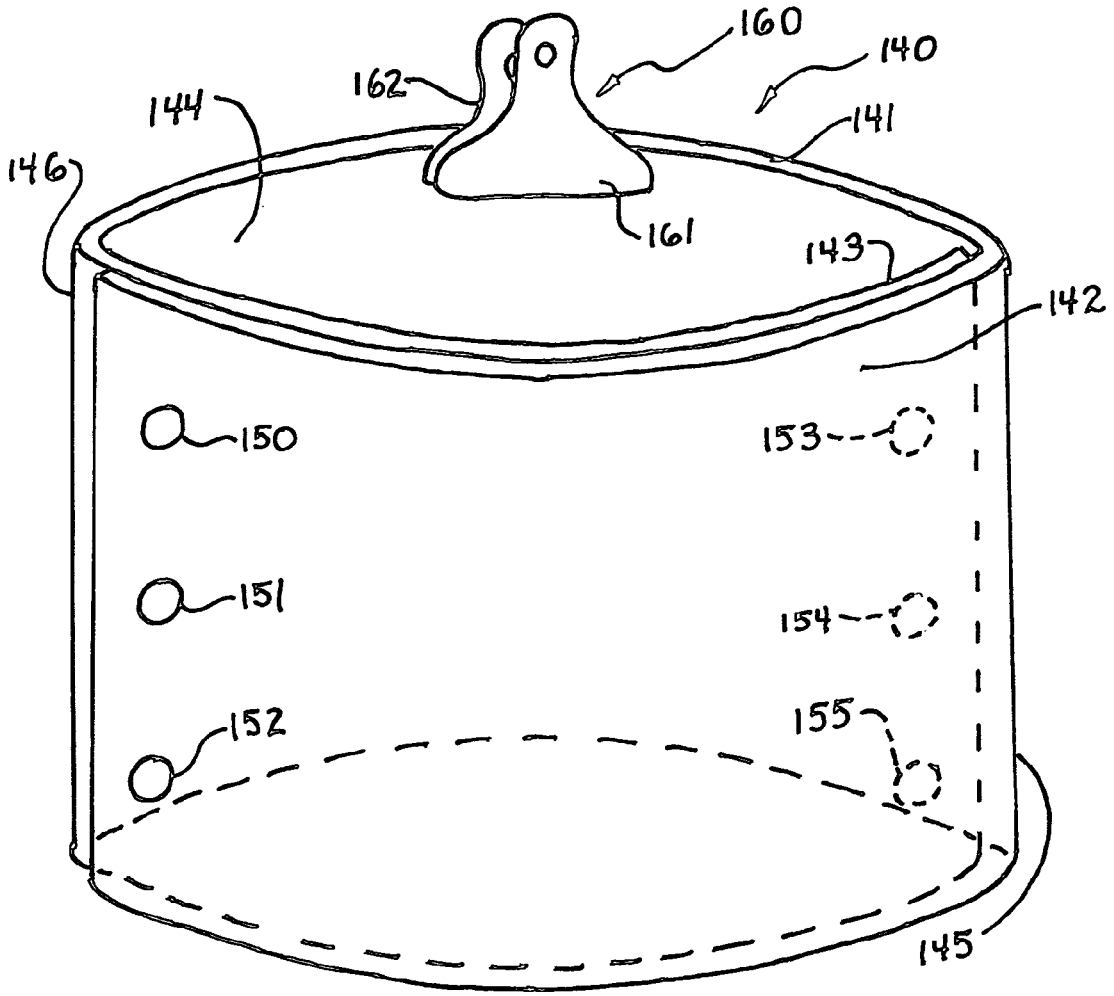
FIG. 16 sets forth a front view of the embodiment of FIG. 14 having the doors thereof in the overlapping configuration.

FIG. 16 shows apparatus 140 in its closed configuration. In this configuration, door 143 is folded upon back 141 enclosing a rinsed diaper (not shown) in a similar configuration to FIG. 12. Thereafter, door 142 is folded over door 143. This provides a squeeze position used to wring excess rinse water from the diaper.

As is described above, apparatus 140 includes a back 141, a door 142 and a door 143. A pair of hinge lines 145 and 146 join doors 142 and 143 respectively to back 141. Doors 142 and 143 are pivoted about hinge lines 145 and 146 to the closed configuration. Door 142 supports a trio of snap fasteners 150, 151 and 152. Door 143 supports snap fasteners 156, 157 and 158 along hinge line 146. Door 142 is secured upon door 143 by the engagement of snap fasteners 150, 151 and 152 to snap fasteners 156, 157 and 158. Snap fasteners 153, 154 and 155 near hinge line 146 are covered by door 143. In the closed configuration, excess rinse water may wrung by squeezing doors 142 and 143 and back 141 in the manner shown above in FIG. 12.

What has been shown is an apparatus for rinsing diapers which avoids the need for extensive handling of soiled diapers. The apparatus shown utilizes a planar base to which a pair of doors are pivotally attached. The doors can be pivoted to an open configuration allowing a soiled diaper to be secured upon the base using a spring clip. The doors are then pivoted to a tented closure forming a rinse channel enclosing the soiled diaper. A water spray may then be directed against the soiled diaper to rinse the diaper. During the rinse, the door closure prevents excessive spray from splashing outside of the apparatus. After the diaper is rinsed, the doors are moved to an overlapping configuration and squeezed against the base to expel excess water. The doors may then be opened and the diaper removed.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. Apparatus for use in rinsing diapers, said apparatus comprising:

a generally planar base having a top portion, a bottom portion, a front surface, and a pair of side edges;

a diaper clip, secured to said base proximate to said top portion, configured to secure a diaper to said base such that the remainder of the diaper extends downwardly upon said front surface; and a pair of generally flat doors, wherein a first of said pair of doors includes an offset lip configured to be received by, and positioned against, a first side edge of a second of said pair of doors, the offset lip positioned adjacent to a first side edge of the first of said pair of doors, each of said doors being pivotally secured to one of said side edges to be pivotable (a) between an open position exposing said front surface, to a closed position in which said offset lip of the first door meets with the side edge of the second door, and said doors generally overlie a diaper on said front surface spaced therefrom to create a triangularly shaped rinse channel between said doors and said front surface allowing rinse water to pass over the diaper on said front surface downwardly through said triangularly shaped rinse channel, or alternatively, (b) between an open position exposing said front surface, to an overlapping closed position in which said doors partially overlap to press against the diaper on said front surface to squeeze the diaper.

2. The apparatus set forth in claim 1 wherein said door engagements are formed on said door edges.

3. The apparatus set forth in claim 2 wherein said diaper clip comprises:

a movable jaw pivotably supported upon said top portion of said base; and a spring urging said movable jaw toward said base.

4. The apparatus set forth in claim 3 wherein said base and said doors are formed of generally planar plastic members.

5. The apparatus set forth in claim 1 wherein said doors include hinges for pivotally securing said doors to said side edges of said base.

6. The apparatus set forth in claim 1 wherein said base and said doors are formed of an integral one-piece plastic member.

7. The apparatus set forth in claim 6 wherein said one-piece member includes living hinges joining said doors to said base.

8. The apparatus set forth in claim 1 wherein said diaper clip includes a slot formed in said upper portion of said base.

* * * * *